US008948644B2

(12) United States Patent
Fujita et al.

(10) Patent No.: US 8,948,644 B2
(45) Date of Patent: Feb. 3, 2015

(54) POWER SUPPLY MODULE AND IMAGE FORMING APPARATUS INCLUDING SAME

(75) Inventors: Junpei Fujita, Kanagawa (JP); Tomokazu Takeuchi, Tokyo (JP); Hiroyoshi Haga, Kanagawa (JP); Hiromi Ogiyama, Tokyo (JP); Yasunobu Shimizu, Kanagawa (JP); Kenji Sengoku, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 212 days.

(21) Appl. No.: 13/472,743

(22) Filed: May 16, 2012

(65) Prior Publication Data

US 2012/0328320 A1 Dec. 27, 2012

(30) Foreign Application Priority Data

Jun. 21, 2011 (JP) ..... 2011-137197

(51) Int. Cl.
*G03G 15/00* (2006.01)
*G03G 15/16* (2006.01)

(52) U.S. Cl.
CPC ..... *G03G 15/1645* (2013.01); *G03G 15/50* (2013.01)
USPC ..... 399/88; 399/315

(58) Field of Classification Search
USPC ..... 399/88, 90, 314
See application file for complete search history.

(56) References Cited

U.S. PATENT DOCUMENTS 4,190,348 A 2/1980 Friday
4,528,937 A 7/1985 Kanno et al.
4,851,874 A 7/1989 Ogiyama
5,029,840 A 7/1991 Haga et al.
5,483,330 A 1/1996 Ogiyama et al.
5,991,570 A 11/1999 Haga et al.
6,405,002 B2 6/2002 Ogiyama et al.
6,618,565 B2 9/2003 Tamiya et al.
6,697,595 B2 2/2004 Kawagoe et al.

(Continued)

FOREIGN PATENT DOCUMENTS

CN 1782910 A 6/2006
JP 2000-122450 4/2000

(Continued)

OTHER PUBLICATIONS

Combined Chinese Office Action and Search Report issued Jul. 3, 2014 in Patent Application No. 201210212189.1(with English Translation of Category of Cited Documents).

*Primary Examiner* — David Bolduc
*Assistant Examiner* — Barnabas Fekete
(74) *Attorney, Agent, or Firm* — Oblon, Spivak, McClelland, Maier & Neustadt, L.L.P.

(57) ABSTRACT

An image forming apparatus includes an image bearing member to bear a toner image on a surface thereof, a transfer unit including a transfer device to transfer the toner image onto a recording medium, disposed opposite the image bearing member, a direct current (DC) power source to apply, between the image bearing member and the transfer device, a DC bias to form a first transfer electric field to transfer the toner image onto the recording medium, and a power supply module detachably attachable relative to the image forming apparatus. The power supply module includes an AC-DC superimposed bias power source to apply, between the image bearing member and the transfer device, a superimposed bias in which an alternating voltage is superimposed on a DC voltage to form a second transfer electric field to transfer the toner image onto the recording medium.

18 Claims, 12 Drawing Sheets

(56) References Cited

U.S. PATENT DOCUMENTS

| | | | |
|---|---|---|---|
| 6,741,821 | B2 | 5/2004 | Sugino et al. |
| 6,785,500 | B2 | 8/2004 | Takahashi et al. |
| 6,829,450 | B2 | 12/2004 | Tamiya et al. |
| 6,901,234 | B2 | 5/2005 | Ogiyama et al. |
| 7,003,238 | B2 | 2/2006 | Yoshida et al. |
| 7,203,433 | B2 | 4/2007 | Kato et al. |
| 7,277,657 | B2 | 10/2007 | Uchida et al. |
| 7,280,792 | B2 | 10/2007 | Sawai et al. |
| 7,346,287 | B2 | 3/2008 | Ogiyama et al. |
| 7,610,004 | B2 | 10/2009 | Kato et al. |
| 7,773,928 | B2 | 8/2010 | Ogiyama et al. |
| 8,135,319 | B2 | 3/2012 | Fujita |
| 2003/0118359 | A1 | 6/2003 | Ogiyama et al. |
| 2008/0232867 | A1 | 9/2008 | Minbu et al. |
| 2010/0040386 | A1 | 2/2010 | Mizutani et al. |
| 2010/0067952 | A1 | 3/2010 | Fujita et al. |
| 2010/0080631 | A1 | 4/2010 | Ogiyama et al. |
| 2010/0098446 | A1 | 4/2010 | Ishikawa et al. |
| 2010/0142985 | A1 | 6/2010 | Minbe et al. |
| 2010/0221029 | A1 | 9/2010 | Minbu et al. |
| 2011/0064487 | A1 | 3/2011 | Ichihashi et al. |
| 2011/0158690 | A1 | 6/2011 | Mimbu et al. |
| 2011/0181116 | A1 | 7/2011 | Takeuchi et al. |
| 2011/0206399 | A1 | 8/2011 | Fujita et al. |
| 2011/0286759 | A1 | 11/2011 | Ichihashi et al. |
| 2011/0293312 | A1 | 12/2011 | Mimbu et al. |
| 2012/0008991 | A1 | 1/2012 | Shimizu |
| 2012/0045237 | A1* | 2/2012 | Aoki et al. ..... 399/66 |

FOREIGN PATENT DOCUMENTS

| | | |
|---|---|---|
| JP | 2001-356653 | 12/2001 |
| JP | 2002-182498 | 6/2002 |
| JP | 2005-195635 | 7/2005 |
| JP | 2010-281907 | 12/2010 |
| JP | 2012-42835 A | 3/2012 |

* cited by examiner

POWER SUPPLY MODULE AND IMAGE FORMING APPARATUS INCLUDING SAME

CROSS-REFERENCE TO RELATED APPLICATION

This patent application is based on and claims priority pursuant to 35 U.S.C. §119 to Japanese Patent Application No. 2011-137197, filed on Jun. 21, 2011 in the Japanese Patent Office, the entire disclosure of which is hereby incorporated by reference herein.

BACKGROUND OF THE INVENTION

1. Field of the Invention

Exemplary aspects of the present disclosure generally relate to an image forming apparatus, such as a copier, a facsimile machine, a printer, or a multi-functional system including a combination thereof, and more particularly, to a power supply module that supplies a bias in which an alternating current voltage is superimposed on a direct current voltage to transfer a toner image onto a recording medium and an image forming apparatus including the power supply module.

2. Description of the Related Art

Related-art image forming apparatuses, such as copiers, facsimile machines, printers, or multifunction printers having at least one of copying, printing, scanning, and facsimile capabilities, typically form an image on a recording medium according to image data. Thus, for example, a charger uniformly charges a surface of an image bearing member (which may, for example, be a photoconductive drum); an optical writer projects a light beam onto the charged surface of the image bearing member to form an electrostatic latent image on the image bearing member according to the image data; a developing device supplies toner to the electrostatic latent image formed on the image bearing member to render the electrostatic latent image visible as a toner image; the toner image is directly transferred from the image bearing member onto a recording medium or is indirectly transferred from the image bearing member onto a recording medium via an intermediate transfer member by a transfer electric field generated by a certain voltage such as a direct current (DC) voltage; a cleaning device then cleans the surface of the image carrier after the toner image is transferred from the image carrier onto the recording medium; finally, a fixing device applies heat and pressure to the recording medium bearing the unfixed toner image to affix the unfixed toner image on the recording medium semi-permanently, thus forming the image on the recording medium.

There is increasing market demand for an image forming apparatus capable of forming an image on various kinds of recording media sheets such as ones having a coarse surface, for example, Japanese paper and an embossed sheet. However, transferring a toner image onto a recording medium having a coarse surface using the transfer electric field generated by the DC voltage using the conventional configuration, a pattern of light and dark patches according to the surface condition of the recording medium appears in an output image. This is because the toner is transferred poorly to recessed portions on the surface of the recording medium, and as a result, the density of toner at the recessed portions is less than that of projecting portions of the recording medium.

In order to obtain an image without uneven toner concentration regardless of the surface condition of the recording medium, the transfer electric field can be generated using a superimposed bias in which an alternating current (AC) voltage is superimposed on a DC voltage. In this configuration, the AC-DC superimposed bias is applied to a secondary transfer member such as a secondary transfer roller. The AC-DC superimposed bias is composed of a DC voltage and an AC voltage in which a relatively high first peak-to-peak voltage and a relatively low second peak-to-peak voltage alternate. The transfer electric field generated by the AC-DC superimposed bias enables the toner image on the intermediate transfer belt serving as an image bearing member to move to the recording medium. Accordingly, unevenness of image concentration is reduced. The mechanism by which this feat is accomplished is as follows.

Initially, with application of a transfer bias composed of a superimposed bias at first only a small number of toner particles on the toner layer on the image bearing member separates from the toner layer and moves to the recording medium; most of the toner particles remain in the toner layer.

After the toner particles separated from the toner layer enter the recessed portions of the recording medium, the polarity of the transfer electric field reverses due to the AC voltage. As a result, the toner particles in the recessed portions return to the toner layer. When this happens, the toner particles returning to the toner layer strike the toner particles remaining in the toner layer, thereby weakening adhesion of the toner particles in the toner layer. Subsequently, when the polarity of the transfer electric field reverses towards the direction of the recording medium, more toner particles than the initial time separate from the toner layer and move to the recessed portions of the recording medium.

As this process is repeated, the amount of toner particles separating from the toner layer and entering the recessed portions of the recording medium can be increased, thereby transferring adequately the toner to the recessed portions of the recording medium.

However, although effective, in order to apply the AC-DC superimposed voltage, various components are required. For example, an AC power source for supplying the AC voltage, components that control the power source such as a signal line, and a harness that connects the AC power source and the transfer device are required.

Although an AC-DC superimposed bias is used to transfer a toner image onto a recording medium with a coarse surface as described above, the transfer electric field is generated using only the DC voltage (direct current bias) when forming an image on a normal sheet. In such a case, a switching mechanism such as a relay is required to switch between the biases to produce different transfer electric fields.

In known image forming apparatuses that use an AC-DC superimposed bias, arrangement of various constituent components to produce and control the AC-DC superimposed bias such as the AC voltage power source, harnesses, signal lines, and a relay is not discussed in detail. Yet in order to satisfy recent demand for overall size reduction of the image forming apparatus, arrangement of the constituent components is important. Furthermore, to reduce the time and the cost of assembly of the image forming apparatus, the constituent components need to be assembled easily. Hence, arrangement of the components is critical in this regard as well.

In addition, it is conceivable that users purchase an image forming apparatus without the components for application of the AC-DC superimposed bias but later wish to add these components optionally. In such a case, a technician needs to be called in to install the components required for application of the AC-DC superimposed bias. However, as is generally the case for the image forming apparatus, the power source and the like that are not expected to be touched or removed by the user are disposed at the back of the image forming apparatus. In order to attach the additional components for the AC-DC superimposed bias to the existing image forming apparatus, it may be necessary to move the image forming apparatus so that he or she can access the back of the image forming apparatus, which generally faces a wall of the office upon installation of these components.

As is obvious, if installation of the components in the image forming apparatus is time-consuming, downtime, that is, a period of time during which the device is not operated, also lengthens. Moreover, if installation of the components requires disassembly of the image forming apparatus to some extent, a relatively large working space is required, which is inconvenient for the user.

In view of the above, there is demand for an image forming apparatus that combines good imaging capability regardless of the surface condition of the recording medium with ease of installation of the components needed to generate the AC-DC superimposed bias.

BRIEF SUMMARY OF THE INVENTION

In view of the foregoing, in an aspect of this disclosure, there is provided an image forming apparatus including an image bearing member, a transfer unit, a direct current (DC) power source, and a power supply module. The image bearing member bears a toner image on a surface thereof. The transfer unit disposed opposite the image bearing member includes a transfer device to transfer the toner image onto a recording medium. The direct current (DC) power source applies, between the image bearing member and the transfer device, a DC bias to form a first transfer electric field to transfer the toner image onto the recording medium. The power supply module is detachably attachable relative to the image forming apparatus. The power supply module includes an AC-DC superimposed bias power source to apply, between the image bearing member and the transfer device, a superimposed bias in which an alternating voltage is superimposed on a DC voltage to form a second transfer electric field to transfer the toner image onto the recording medium.

According to another aspect, there is provided a power supply module detachably attachable relative to an image forming apparatus. The power supply module includes a power source to output a superimposed bias in which an AC voltage is superimposed on a DC voltage. The superimposed bias is applied to a transfer device of the image forming apparatus.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF DISCLOSED EMBODIMENTS

Figure 1:
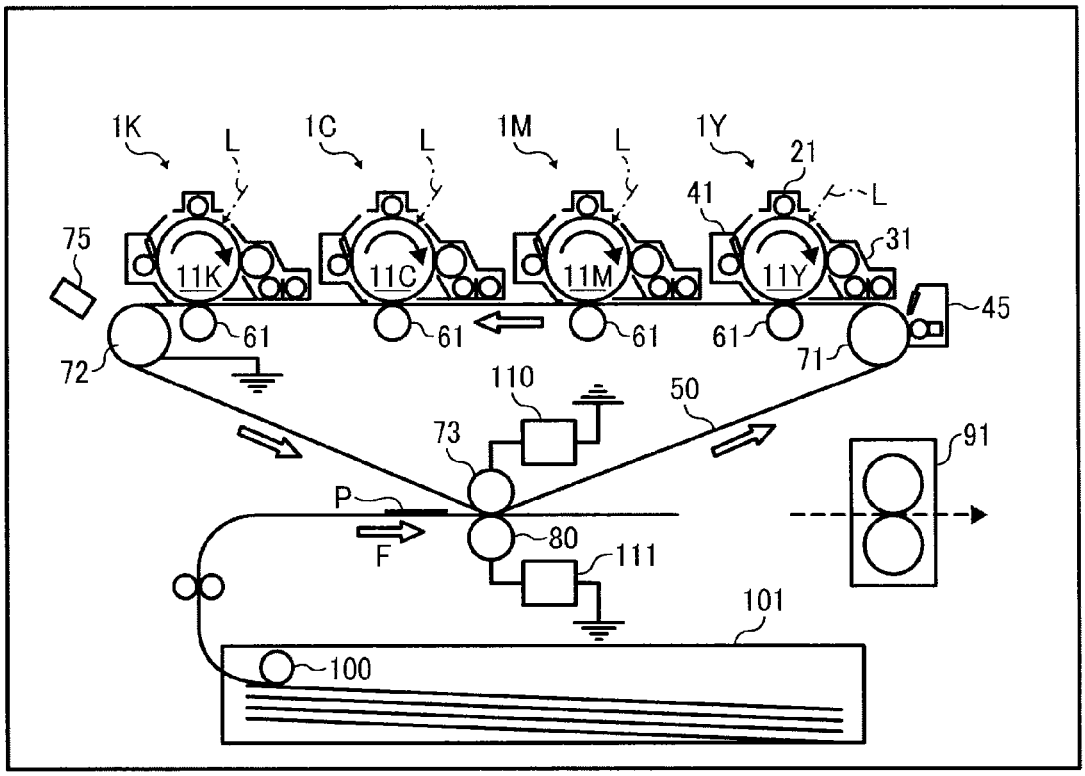
FIG. 1 is a cross-sectional diagram schematically illustrating a color printer as an example of an image forming apparatus according to an illustrative embodiment of the present invention.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, and initially with reference to FIG. 1, a description is provided of an image forming apparatus according to an aspect of this disclosure.

FIG. 1 is a schematic diagram illustrating a color printer as an example of the image forming apparatus according to an illustrative embodiment of the present invention.

According to the illustrative embodiment, the image forming apparatus produces a color image by superimposing four color components yellow (Y), magenta (M), cyan (C), and black (K) one atop the other. As illustrated in FIG. 1, the image forming apparatus includes image forming units 1Y, 1M, 1C, and 1K for the colors yellow, magenta, cyan, and black, respectively. The image forming units 1Y, 1M, 1C, and 1K are disposed slightly above the center of the image forming apparatus. It is to be noted that the suffixes Y, M, C, and K denote colors yellow, magenta, cyan, and black, respectively. To simplify the description, these suffixes are omitted herein, unless otherwise specified.

The image forming units 1Y, 1M, 1C, and 1K include photoconductive drums 11Y, 11M, 11C, and 11K, one for each of the colors yellow, magenta, cyan, and black respectively. It is to be noted that the photoconductive drums 11Y, 11M, 11C, and 11K are hereinafter collectively referred to as photoconductive drums 11 when discrimination therebetween is not required.

The image forming units 1Y, 1M, 1C, and 1K are arranged in tandem along a belt-type image bearing member 50 (hereinafter referred to as simply "intermediate transfer belt"), and the photoconductive drums 11 contact the intermediate transfer belt 50. Toner images of yellow, magenta, cyan, and black are formed on the respective color of the photoconductive drums 11 and then transferred onto the intermediate transfer belt 50 such that they are superimposed one atop the other, thereby forming a composite color toner image.

The toner images having been transferred onto the intermediate transfer belt 50 are transferred onto a recording medium such as a recording sheet fed from a sheet cassette 101 by a sheet feed roller 100. More particularly, the sheet cassette 101 stores a stack of multiple recording media sheets, and the sheet feed roller 100 sends a top sheet, in appropriate timing, to a place called a secondary transfer nip at which a secondary transfer roller 80 serving as a transfer device and a secondary transfer counter roller 73 contact each other via the intermediate transfer belt 50. The composite color toner image on the intermediate transfer belt 50 is transferred onto the recording medium at the secondary transfer nip in a process known as secondary transfer. After the secondary transfer, the recording medium, onto which the composite color toner image is transferred, is transported to a fixing device 91 in which heat and pressure are applied to the recording medium, thereby affixing the composite toner image on the recording medium.

Figure 2:
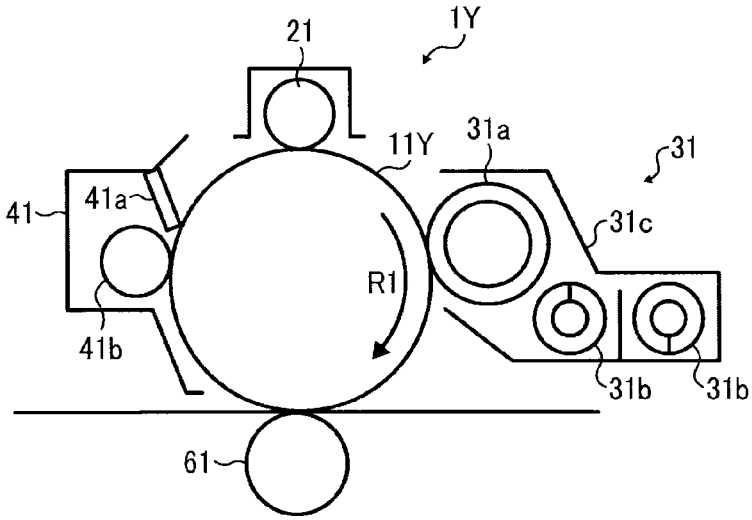
FIG. 2 is a cross-sectional diagram schematically illustrating an image forming unit for the color yellow as a representative example of the image forming units employed in the image forming apparatus of FIG. 1 according to an illustrative embodiment of the present invention.

With reference to FIG. 2, a description is provided of the image forming unit 1Y as a representative example of the image forming units 1. It is to be noted that the image forming units 1Y, 1M, C, and 1K all have the same configurations as all the others, differing only in the color of toner employed. Hence, a description is provided of the image forming unit 1Y for the color yellow. FIG. 2 is a cross-sectional diagram schematically illustrating the image forming unit 1Y according to an illustrative embodiment of the present invention.

As illustrated in FIG. 2, in the image forming unit 1Y, the photoconductive drum 11Y is surrounded by various pieces of imaging equipment, such as a charging device 21, a developing device 31, a drum cleaner 41, and a primary transfer roller 61. It is to be noted that the suffix Y indicating the color yellow is omitted.

The charging device 21 includes a charging roller that charges the surface of the photoconductive drum 11. The developing device 31 develops a latent image formed on the photoconductive drum 11 with toner, thereby forming a visible image, known as a toner image on the photoconductive drum 11Y. The toner image borne on the surface of the photoconductive drum 11Y is transferred onto the intermediate transfer belt 50 by the primary transfer roller 61 in a process known as primary transfer. After primary transfer, toner remaining on the photoconductive drum 11Y is removed by the drum cleaner 41.

The charging roller of the charging device 21 is constituted of a conductive elastic roller supplied with a voltage in which an alternating current (AC) voltage is superimposed on a direct current (DC) voltage. The charging roller contacts the photoconductive drum 11Y. Electrical discharge is induced directly between the charging roller and the photoconductive drum 11Y, thereby charging the photoconductive drum 11Y to a predetermined polarity, for example, a negative polarity. Instead of using the charging roller or the like that contacts the photoconductive drum 11Y, a corona charger that does not contact the photoconductive drum 11Y may be employed.

Subsequently, referring back to FIG. 1, the charged surfaces of the photoconductive drums 11Y, 11M, 11C, and 11K are illuminated with modulated light beams L projected from an optical writer. Accordingly, electrostatic latent images are formed on the surfaces of the photoconductive drums 11Y, 11M, 11C, and 11K. More specifically, when the surfaces of the photoconductive drums 11Y, 11M, 11C, and 11K are illuminated with the light beams L, the place where absolute values of the potential drops appears as a latent image (an image portion), and the place where the light beams do not illuminate so that the absolute values of the potential remain high becomes a background portion where no image is formed.

In FIG. 2, the developing device 31 includes a developer container 31*c*, a developing sleeve 31*a*, and paddles 31*b*. The developer container 31*c* includes an opening facing the photoconductive drum 11Y. In the developer container 31*c*, a two-component developing agent consisting of toner and carrier is stored. The developing sleeve 31*a* is disposed in the developer container 31*c* and faces the photoconductive drum 11 via the opening of the container 31*c*. The paddles 31*b* mix the developing agent and transport the developing agent to the developing sleeve 31*a*. Each paddle 31*b* is disposed at the developing sleeve side from which the developing agent is supplied to the developing sleeve 31*a* and at a toner receiving side from which fresh toner is supplied by a toner supply device (not illustrated). Although not illustrated, the paddles 31*b* are rotatably supported by shaft bearings. The toner transported onto the developing sleeve 31*a* while being mixed by the paddles 31*b* is attracted electrostatically to the latent image on the photoconductive drum 11Y, thereby developing the latent image into a visible image, known as a toner image.

The intermediate transfer belt 50 is a belt formed into a loop, entrained around a plurality of rollers, and rotated endlessly. The primary transfer rollers 61 are disposed inside the loop formed by the intermediate transfer belt 50 and contact the photoconductive drums 11Y via the intermediate transfer belt 50. The primary transfer rollers 61 are conductive elastic rollers. A constant-current controlled primary transfer bias is applied to the primary transfer rollers 61. The primary transfer bias causes the toner image on the photoconductive drum 11 to be transferred onto the intermediate transfer belt 50.

The drum cleaner 41 includes a cleaning blade 41*a* and a cleaning brush 41*b*. The cleaning blade 41*a* contacts the photoconductive drum 11 against the direction of rotation of the photoconductive drum 11Y. The cleaning brush 41*b* contacts the photoconductive drum 11Y while rotating in a direction opposite to that of the photoconductive drum 11Y. With this configuration, the toner remaining on the surface of the photoconductive drum 11Y after primary transfer is removed.

The photoconductive drums 11Y, 11M, 11C, and 11K are rotated in the clockwise direction indicated by an arrow in FIG. 1 by a driving device, not illustrated. It is to be noted that the photoconductive drum 11K for the color black is rotated independently from other photoconductive drums 11Y, 11M, and 11C for color imaging. In this configuration, when forming a monochrome image, only the photoconductive drum 1K for the color black is rotated; whereas, when forming a color image, all four photoconductive drums 11Y, 11M, 11C, and 11K are driven at the same time. According to the present illustrative embodiment, when forming a monochrome image, an intermediate transfer unit including the intermediate transfer belt 50 is swingably separated from the photoconductive drums 11Y, 11M, and 11C.

The intermediate transfer belt 50 serving as an image bearing member is formed into a loop and entrained around a plurality of rollers: a secondary transfer counter roller 73, and support rollers 71 and 72. The intermediate transfer belt 50 is formed of a belt having a medium resistance. One of the rollers 71, 72, and 73 is driven to rotate so that the intermediate transfer belt 50 is moved endlessly in the counterclockwise direction indicated by a hollow arrow in FIG. 1.

The support roller 72 is grounded. As illustrated in FIG. 1, a surface voltmeter 75 is disposed opposite the support roller 72. The surface voltmeter 75 measures a surface potential when the toner image on the intermediate transfer belt 50 passes over the support roller 72.

Still referring to FIG. 1, a description is provided of an AC-DC superimposed bias applied between the intermediate transfer belt 50 and the secondary transfer roller 80. The AC-DC superimposed bias is a bias in which a direct current (DC) voltage and an alternating current (AC) voltage are superimposed.

As illustrated in FIG. 1, in order to apply the AC-DC superimposed bias between the intermediate transfer belt 50 and the secondary transfer roller 80, the image forming apparatus includes a first power source unit 110 and a second power source unit 111. The first power source unit 110 is connected to a secondary transfer counter roller 73. The second power source unit 111 is connected to the secondary transfer roller 80 serving as a transfer device.

To transfer a toner image from the intermediate transfer belt 50 to a recording medium P, the first power source unit 110 and/or the second power source unit 111 supplies a voltage having a DC voltage component in the direction of transfer of the toner from the intermediate transfer belt 50 to the recording medium P. In addition to the DC voltage component, an AC voltage component or the AC component superimposed with the DC component is supplied by the first power source unit 110 and/or the second power source unit 111.

A transfer electric field generated by the AC-DC superimposed bias acts on the toner image on the intermediate transfer belt 50, and then the toner image is transferred electrostatically to a predetermined position on the recording medium P, as the recording medium P passes through the secondary transfer nip between the intermediate transfer belt 50 and the secondary transfer roller 80 in the direction indicated by an arrow F in FIG. 1.

The configuration of the first power source unit 110 and/or the second power source unit 111 for application of the AC-DC superimposed bias is not limited to the configuration shown in FIG. 1. For example, one of the first power source unit 110 and the second power source unit 111 is provided to supply the superimposed voltage. Alternatively, as illustrated in FIG. 1, both first power source unit 110 and the second power source unit 111 are disposed so that the AC voltage and the DC voltage are applied separately by the first power source unit 110 and the second power source unit 111. Furthermore, one of the first power source unit 110 and the second power source unit 111 may supply the AC-DC superimposed voltage, and the other power source unit may supply the DC voltage.

An output voltage may be selected from the voltage with only the DC voltage component and the voltage with the AC-DC superimposed voltage component. With this configuration, depending on the type of the recording medium, the transfer electric field can be switched between the transfer electric field generated only by the DC voltage component and the transfer electric field generated by the AC-DC superimposed bias. For example, when the recording medium P is a normal sheet of paper having a smooth surface compared with a coarse surface such as an embossed sheet and Japanese paper, only the DC voltage component may be supplied.

The advantage of this configuration is that in applications that do not require any AC voltage, the transfer unit may be used only with the DC voltage component, thereby saving the energy. In this case, the power source unit capable of supplying the AC-DC superimposed voltage is configured to supply only the DC voltage component by not supplying the AC voltage. Alternatively, separate power source circuits may be provided for application of the DC voltage and application of the AC voltage, or for application of the superimposed voltage. By switching the power source circuits, a desired voltage can be selected, that is, the DC voltage and the superimposed voltage can be switched.

Figure 3:
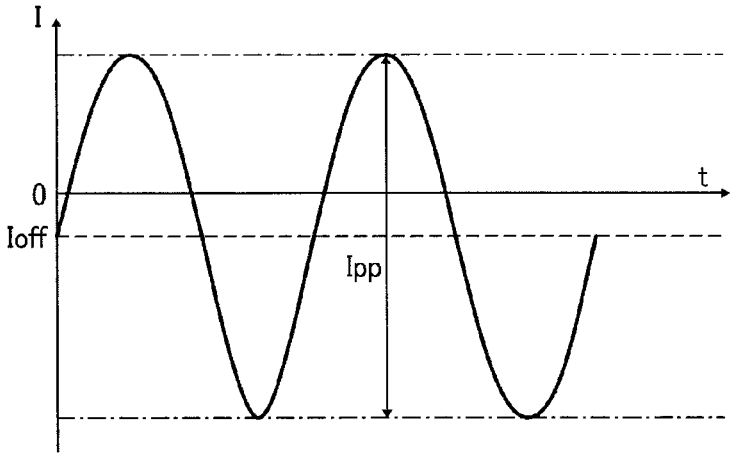
FIG. 3 is a graph showing an example of electric current when an AC-DC superimposed bias in which an AC voltage is superimposed on a DC current is applied.

With reference to FIG. 3, a description is provided of an example of a current value when the AC-DC superimposed bias in which a DC voltage is superimposed on an AC voltage is applied to the secondary transfer counter roller 73 by the first power source unit 110 and/or the second power source unit 111.

Figure 4:
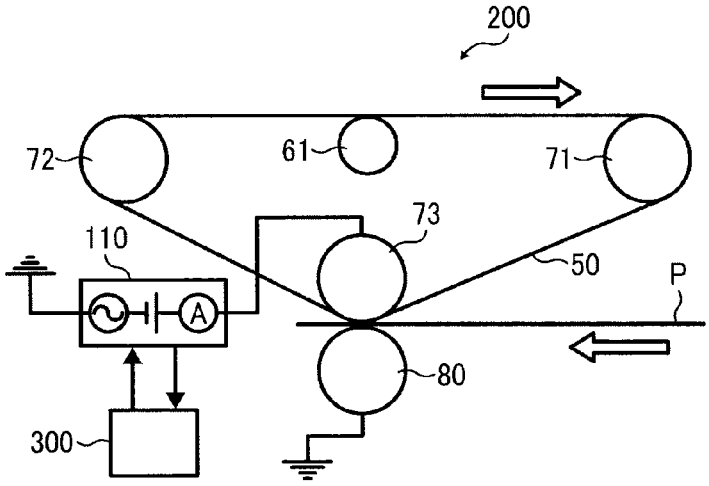
FIG. 4 is a schematic diagram illustrating a transfer unit employed in the image forming apparatus of FIG. 1 according to an illustrative embodiment of the present invention.

FIG. 3 is a graph showing the electric current flowing to the secondary transfer counter roller 73 when the first power source unit 110 applies the AC-DC superimposed bias to the secondary transfer counter roller 73 as illustrated in FIG. 4. In other words, FIG. 3 shows an example of the current value of the AC-DC superimposed bias when the first power source unit 110 shown in FIG. 4 applies the AC-DC superimposed bias to the secondary transfer counter roller 73 to transfer the toner image from the intermediate transfer belt 50 to the recording medium P.

FIG. 4 is a schematic diagram illustrating a transfer unit 200 in which the toner image on the intermediate transfer belt 50 is transferred onto the recording medium P using the transfer electric field generated under the constant current control. According to the present embodiment, the DC voltage is superimposed on the AC voltage. The transfer electric field is generated under the constant current control in which the output voltage is regulated such that the DC component (offset current) Ioff of the output current or the current Ipp between peaks of the AC component achieves a predetermined current level, thereby transferring the toner image from the intermediate transfer belt 50 onto the recording medium P.

The voltage output from the first power source unit 110 as shown in FIG. 3 is regulated such that the current value Ioff of the DC component or the current value Ioff and the current value Ipp between the peaks of the AC component obtains a predetermined current value. It is to be noted that, since the primary transfer rollers 61 have the same configuration except the color of toner employed, for simplicity, FIG. 4 shows only one primary transfer roller 61 as a representative example, In contrast to the constant current control as described above, the toner image can be transferred to the recording medium by applying the AC-DC superimposed bias under the constant voltage control in which the output voltage is regulated such that the DC component Voff of the output voltage or the voltage Vpp between peaks of the AC component achieves a predetermined value. However, in a case in which the output voltage is subjected to the constant voltage control, the applied voltage needs to be changed significantly in order to obtain good transferability when the resistance of constituent parts changes due to humidity and the material of the recording medium is different. By contrast, fluctuation of the transferability is small in the same situation under the constant current control. For this reason, the constant current control is preferred.

In the image forming apparatus shown in FIG. 4 in which the electric current shown in FIG. 3 is supplied by the first power source unit 110, the secondary transfer roller 80 serving as a transfer device is grounded while the secondary transfer counter roller 73 is supplied with a voltage by the first power source unit 110. The first power source unit 110 is regulated by a control circuit 300.

In the configuration described above, Ioff is detected by a built-in ammeter in the first power source unit 110, and the result is provided to the control circuit 300. Subsequently, the control circuit 300 provides a control signal to the first power source unit 110. The control circuit 300 outputs the control signal in accordance with a set value of a current while the first power source unit 110 adjusts an output voltage such that the output Ioff achieves the set value. When Ipp is subjected to the constant current control, Ipp can be regulated in the same or similar manner as described above.

According to the study by the present inventors, Ioff represents movement of electrical charge by the toner or by electrical discharge. Therefore, Ioff setting can be generated using the amount of current generated by the toner movement as a guideline.

The current Itoner generated by the toner movement can be expressed by the following equation:

$$Itoner=v*W*Q/M*M/A*10,$$

where v represents a velocity [m/s] of the recording medium P, W represents a width [m] of an image in the axial direction of the roller, Q/M represents an electrical charge of toner [μC/g], WA represents an amount of adhered toner [mg/cm$^2$].

For the values of the image width and the amount of adhered toner, the maximum values that are assumed when a solid image is transferred onto a recording medium are used to allow all toner to be transferred. For example, when v=0.3 [μm/s], W=0.3 [μm], Q/M=−30 [μC/g], and M/A=0.5 [μg/cm$^2$], Itoner is −13.50 [μA]. In this case, preferably, the absolute value of Ioff is set to a value equal to or greater than |Itoner|, for example, Ioff=−20 [μA]. The setting for Ioff when changing the velocity v of the recording medium P can be obtained by obtaining Itoner using the equation above. For example, when v=0.15 [μm/s], Ioff is −6.75 [μA]. Therefore, Ioff is set as Ioff=−10 [μA].

In a case in which the velocity (linear velocity) is changed to accommodate different types of recording media sheets, different modes for automatically switching Ioff to accommodate different velocities may be provided to achieve stable image quality for different velocities of recording media sheets. Furthermore, the Ioff setting for a color image having an WA greater than that of a monochrome image can be estimated from the equation above. For example, assuming that the M/A for the color image is 1.0 [μg/cm$^2$] which is twice that of a monochrome image, Ioff may be set to −40 [μA] which is also twice that of the monochromatic image. By providing a color printing mode in which the Ioff setting automatically changes depending on output image information, a stable image can be obtained for both color images and monochromatic images.

It is to be noted that the level of Ipp needs to be high enough to produce the electric field for transferring the toner to the recessed portions of the recording medium. If Ipp is too low, the toner is transferred poorly. Although the level of Ipp differs depending on the resistance of the transfer member and the width of the transfer nip, in the present illustrative embodiment, Ipp is set to 3.0 [mA], for example. By setting Ipp to an appropriate value, toner can be transferred reliably to recessed portions of a recording medium regardless of different surface characteristics of recording media sheets. It is to be noted that an optimum level of Ipp may be obtained in advance through analyses and experiments using an actual model.

As described above, the AC-DC superimposed bias is applied between the intermediate transfer belt (the image bearing member) 50 and the secondary transfer counter roller 73 (the transfer device), thereby transferring reliably the toner image from the intermediate transfer belt 50 onto the recording medium P.

According to the illustrative embodiment, the secondary transfer roller 80 is grounded while the secondary transfer counter roller 73 is applied with the AC-DC superimposed bias. Alternatively, the secondary transfer counter roller 73 may be grounded while the secondary transfer roller 80 is applied with applying the AC-DC superimposed bias. In this a case, the polarity of the DC voltage is changed. More specifically, as illustrated in FIG. 3, when the secondary transfer counter roller 73 is applied with the AC-DC superimposed bias while the toner having the negative polarity is used and the secondary transfer roller 80 is grounded, the DC voltage having the negative polarity same as the toner is employed so that a time-averaged potential of the AC-DC superimposed bias has the same polarity as the toner.

By contrast, when the secondary transfer counter roller 73 is grounded and the secondary transfer roller 80 is applied with the AC-DC superimposed bias, the DC voltage having the positive polarity, which is the polarity opposite to the toner, is used so that the time-averaged potential of the AC-DC superimposed bias has the positive polarity which is opposite to the polarity of toner. Instead of applying the AC-DC superimposed bias to the secondary transfer counter roller 73 or the secondary transfer roller 80, the DC voltage may be supplied to one of the rollers, and the AC voltage may be supplied to the other roller.

According to the illustrative embodiment, the secondary transfer roller 80 serving as a transfer member is a roller that contacts the intermediate transfer belt 50 serving as an image bearing member. For example, the secondary transfer roller 80 is constituted of a conductive metal core formed into a cylindrical shape and a surface layer provided on the outer circumferential surface of the metal core. The surface layer is made of resin, rubber, and the like.

Figure 5:
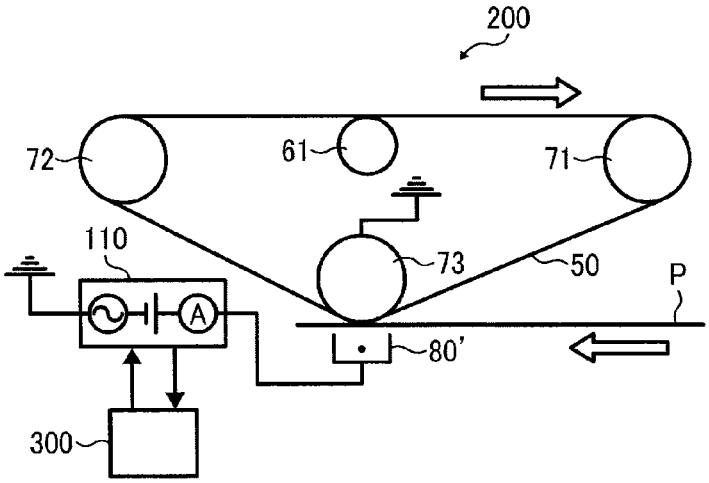
FIG. 5 is a schematic diagram illustrating another example of the transfer unit in which a charger is employed as a transfer device.

The secondary transfer 80 roller is not limited to the above-described structure. As long as the superimposed electric field can be applied to the transfer portion or the transfer nip, as illustrated in FIG. 5, a no-contact charger 80' disposed opposite the intermediate transfer belt 50 may be employed in place of the secondary transfer roller 80, for example. FIG. 5 is a schematic diagram illustrating the transfer unit using the no-contact charger 80'. As illustrated in FIG. 5, the charger 80' does not contact the intermediate transfer belt 50. The transfer unit 200 shown in FIG. 5 employs the charger 80' connected to the first power source unit 110 while the secondary transfer counter roller 73 is grounded. According to the present illustrative embodiment, the charger 80' serves as a transfer device.

Various material may be used for the recording medium P. Material for the recording medium P includes, but is not limited to, resin, metal, and any other suitable material.

According to the present illustrative embodiment, the waveform of the alternating voltage is a sine wave, but other waveforms such as a square wave may be used.

Figure 6:
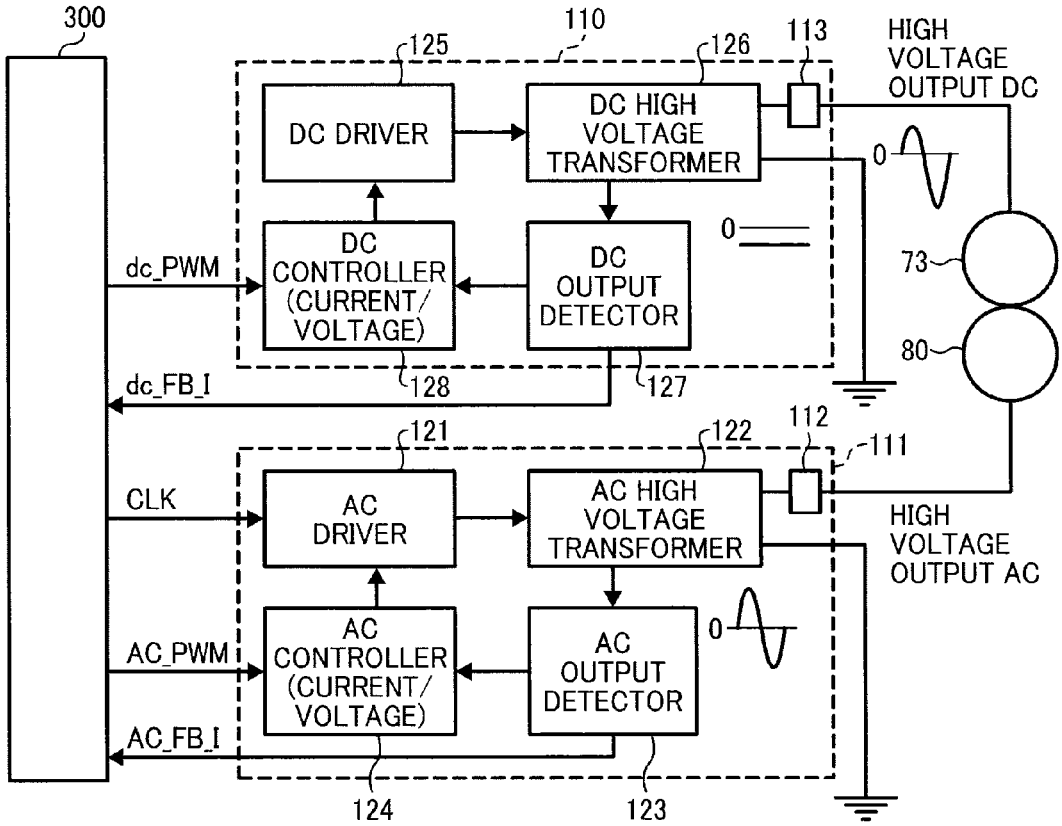
FIG. 6 is a block diagram showing an example of a power source unit that generates the AC-DC superimposed bias.

With reference to FIG. 6, a more detailed description is provided of power source circuits of the power source units 110 and 111. FIG. 6 is a block diagram showing an example of the power source unit that generates the AC-DC superimposed bias. It is to be noted that, for simplicity, the intermediate transfer belt 50 serving as an image bearing member is omitted in FIGS. 6 through 9.

As illustrated in FIG. 6, the second power source unit 111 that supplies an AC voltage is connected to the secondary transfer roller 80 serving as a transfer member, and the first power source unit 110 that supplies a DC voltage is connected to the secondary transfer counter roller 73.

In the second power source unit 111, an AC driver 121, an AC high voltage transformer 122, an AC output detector 123, and an AC controller 124 constitute an AC voltage generator 112.

In the first power source unit 110, a DC driver 125, a DC high voltage transformer 126, a DC output detector 127, and a DC controller 128 constitute a DC voltage generator 113. It is to be noted that an input 24V and the ground (GND) from the control circuit 300 for driving the power source unit 110 and 111 are omitted in FIG. 6.

Each of the power source units 110 and 111 may include an error detector for detecting an erroneous output from the power source units 110 and 111. In this case, a signal line for transmitting an error detection signal from the error detector is connected to the control circuit 300.

According to the illustrative embodiment, a signal that sets a frequency of the AC voltage to be superimposed is supplied from the control circuit 300 to the second power source unit 111 for the AC voltage via a signal line CLK. Further, a signal that sets a current or a voltage of the AC output is supplied from the control circuit 300 to the power source unit 111 via a signal line AC_PWM. A signal for monitoring the AC output is provided to the control circuit 300 via a signal line AC_FB_I.

A signal that sets a current or a voltage of the DC output is supplied from the control circuit 300 to the power source unit 110 for the DC voltage via a signal line dc_PWM. A signal for monitoring the DC output is provided to the control circuit 300 via a signal line dc_FB_I. Based on instructions from the control circuit 300, blocks for controlling the AC and DC (current/voltage) output signals to control driving of each of the respective high voltage transformers 122 and 126 such that the detection signals provided by the output detectors 123 and 127 have predetermined values.

In the AC control, the current and the voltage of AC output is regulated. In other words, both an output current and an output voltage are detected by the AC output detector 123 so that the constant current control and the constant voltage controls can be performed. The same can be said for the DC control.

According to the present embodiment, both the AC and the DC are regulated with a detection result for the current being prioritized so that the constant current control is performed normally. The detection result for the output voltage is used to suppress an upper bound voltage and used to regulate the maximum voltage under unloaded conditions. Monitoring signals output from the AC output detector 123 and the DC output detector 127 are provided to the control circuit 300 as information for monitoring the load conditions. The frequency of the AC voltage is set via the signal line CLK from the control circuit 300. Alternatively, however, a certain frequency can be generated within the AC voltage generator.

According to the illustrative embodiment illustrated in FIG. 6, the first power source unit 110 includes components for application of the DC voltage, and the second power source unit 111 includes components for application of the AC voltage. Alternatively, the components for both application of the AC voltage and the DC voltage may be integrated and constituted as a single power source unit.

Figure 7:
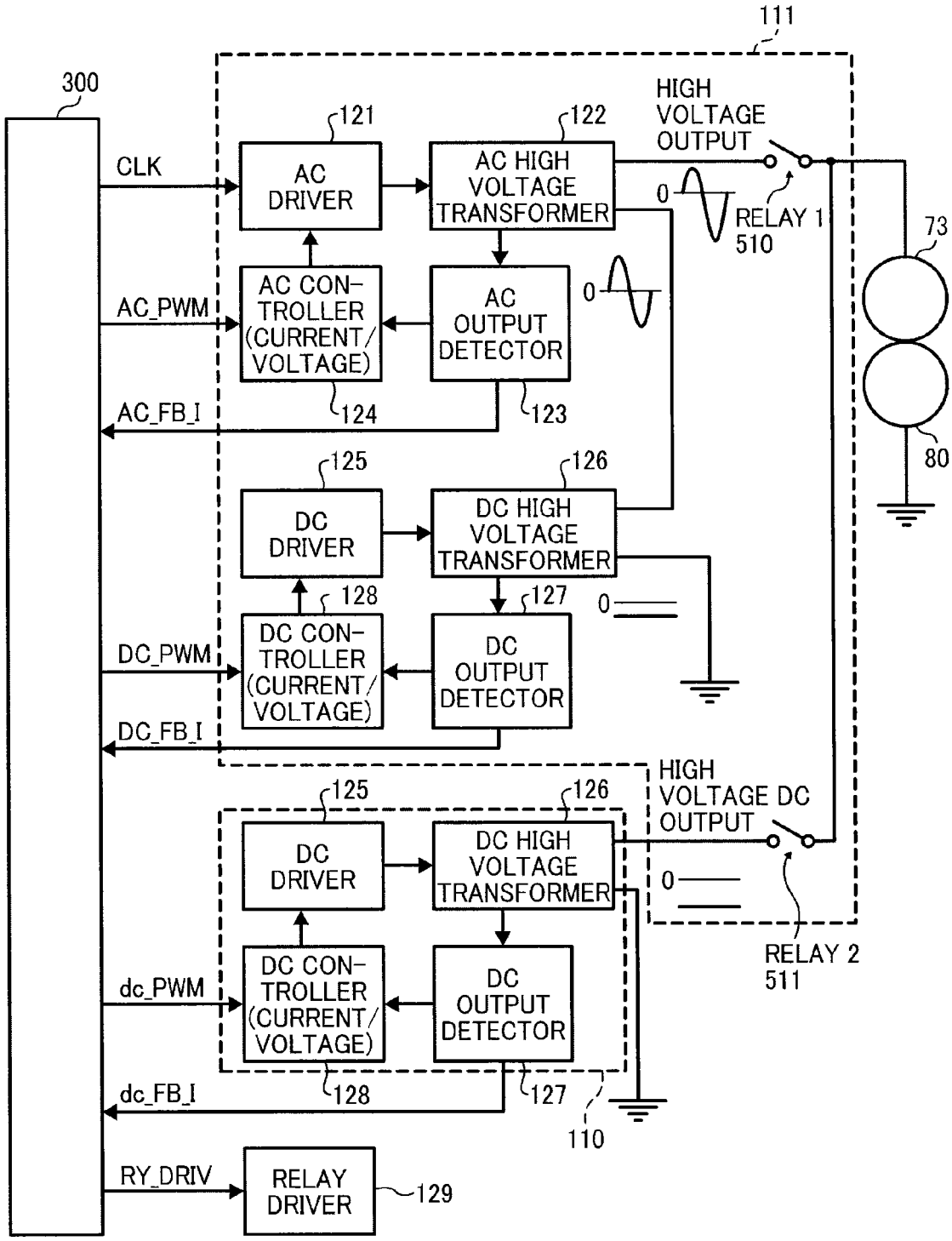
FIG. 7 is a block diagram showing another example of a power source unit that generates the AC-DC superimposed bias.

With reference to FIG. 7, a description is provided of another example of a power source unit for generating the AC-DC superimposed bias. FIG. 7 illustrates a configuration in which application of a voltage with the DC component only and application of the AC-DC superimposed bias can be selected. According to the illustrative embodiment illustrated in FIG. 7, the first power source unit 110 that supplies a voltage containing only the DC component, and the second power source unit 111 that supplies the superimposed voltage are connected in parallel relative to the secondary transfer counter roller 73. With this configuration, the transfer bias can be selected from the AC-DC superimposed bias and the voltage containing only the DC component.

According to the present illustrative embodiment, the second power source unit 111 connected to the secondary transfer counter roller 73 includes a switching mechanism, that is, a first relay 510 and a second relay 511 to switch between the power source unit 110 and the power source unit 111. More specifically, when closing a contact of the first relay 510 and opening a contact of the second relay 511, the AC-DC superimposed bias is applied to the secondary transfer counter roller 73. By contrast, when opening the contact of the first relay 510 and closing the contact of the second relay 511, the secondary transfer counter roller 73 is applied with only the DC voltage bias.

According to the present embodiment, in order to control application of the voltage to the transfer device using the relays, a control signal is passed between the control circuit 300 and each of the power sources 110 and 111. Furthermore, a relay driver 129 is also provided so that switching can be controlled via a signal line RY_DRIV.

Figure 8:
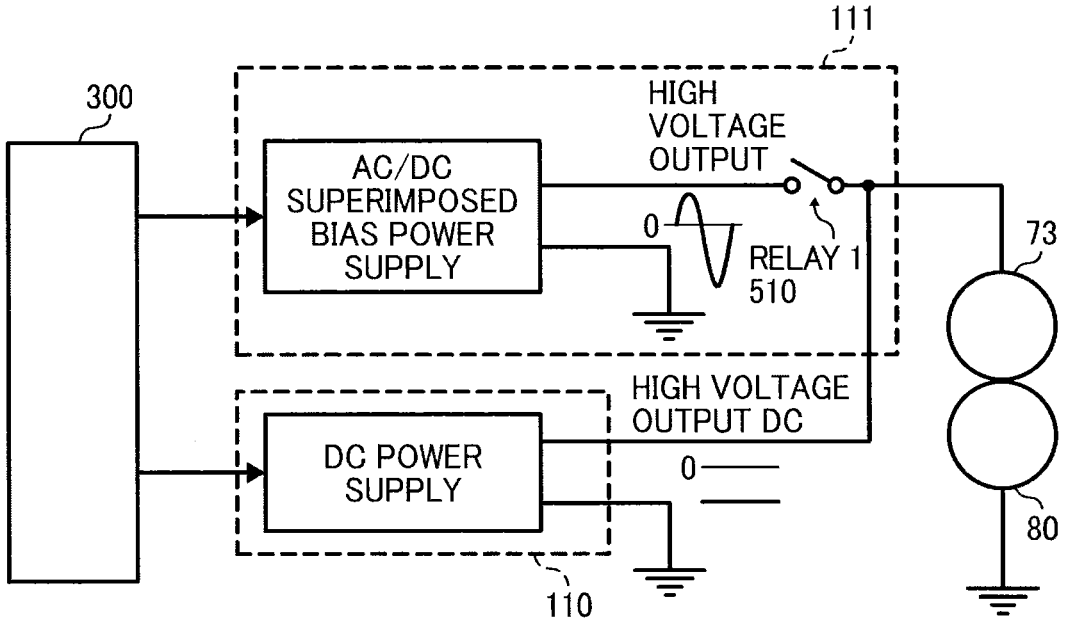
FIG. 8 is a block diagram showing another example of a power source unit that generates the AC-DC superimposed bias.

With reference to FIG. 8, a description is provided of another example of a power source unit that generates the AC-DC superimposed bias. FIG. 8 illustrates a configuration in which the transfer bias can be selected from the AC-DC superimposed bias and the voltage with only the DC component in a similar manner as the configuration illustrated in FIG. 7.

Similar to the foregoing embodiment illustrated in FIG. 7, the transfer bias can be selected from the secondary transfer using the voltage containing only the DC component and the secondary transfer using the AC-DC superimposed voltage. The difference between the configuration illustrated in FIG. 7 and the configuration illustrated in FIG. 8 is that the first relay 510 serving as a switching mechanism is provided only at the output of the second power source unit 111 according to the illustrative embodiment of FIG. 8. The output side of the first relay 510 is connected to the first power source unit 110.

With this configuration, when the AC-DC superimposed bias is output from the second power source unit 111 by closing the contact of the first relay 510, the voltage is supplied to the first power source unit 110 connected in parallel. Although the second power source unit 111 may act as a load on the first power source unit 110, this configuration allows simplification of the circuit as long as the transfer unit is not affected by the current supplied to the first power source unit 110, thereby achieving the same function with a simple and inexpensive configuration.

Figure 9:
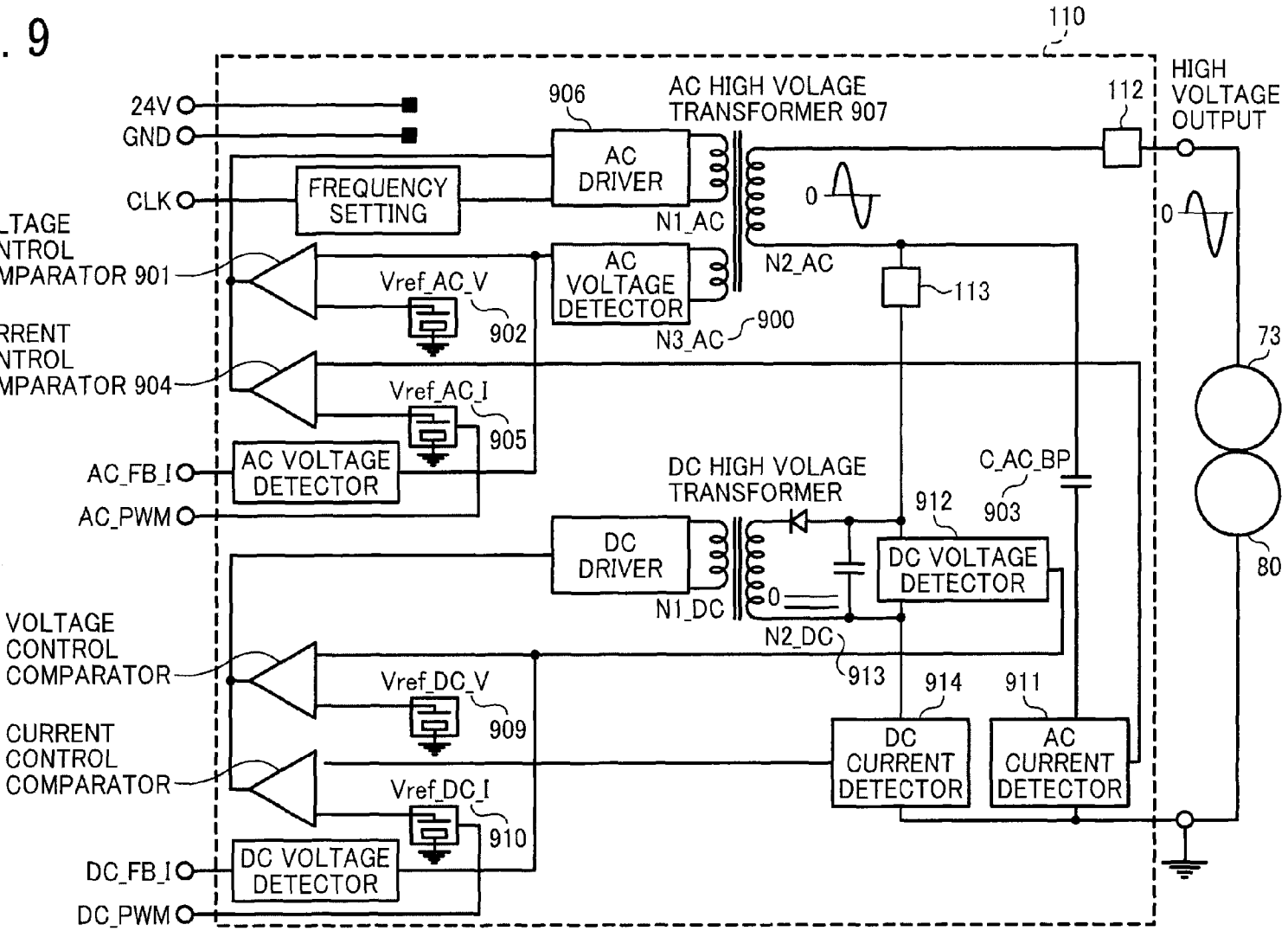
FIG. 9 is a simplified circuit diagram of the power source unit of FIG. 6.

With reference to FIG. 9, a detailed description is provided of the power source unit such as shown in FIG. 6. FIG. 9 is a simplified circuit diagram illustrating the power source unit of FIG. 6. In FIG. 6, the power source unit for application of the AC voltage and the power source unit for application of the DC voltage are illustrated as separate power source units. By contrast, according to an illustrative embodiment shown in FIG. 9, both the power source unit for application of the AC voltage and the power source unit for application of the DC voltage are disposed in the first power source unit 110.

As illustrated in FIG. 9, the constant current control is performed in both the AC voltage generator 112 illustrated substantially in the upper half of FIG. 9 and the DC voltage generator 113 illustrated substantially in the lower half. For the AC voltage, a low voltage approximating to an output of the high voltage transformer is taken out by using a winding N3_AC 900 and compared with a reference signal Vref_AC_V 902 by a voltage control comparator 901. The AC component of the current of the AC is taken out by an AC detector 911 disposed between a capacitor C_AC_BP 903 and the ground, and compared with a reference signal Vref_AC_I 905 by a current control comparator 904. The capacitor C_AC_BP 903 for biasing the AC component is connected in parallel with the output of the DC voltage generator. The level of the reference signal Vref_AC_I 905 is set in accordance with a signal of AC output current for setting supplied via the signal line AC_PMW.

The level of the reference signal Vref_AC_V 902 is set such that when the output voltage reaches or exceeds a predetermined level (for example, at unloaded conditions), the output of the voltage control comparator 901 becomes valid. The level of the reference signal Vref_AC_I 905 is set such that the output of the current control comparator 904 becomes valid under a normal loaded condition. Depending on the degree of loaded conditions (e.g., the secondary transfer counter roller 73, the secondary transfer roller 80, and devices between the rollers), the high voltage output current is switched. The outputs of the voltage control comparator 901 and the current control comparator 904 are provided to an AC driver 906, and an AC high voltage transformer 907 is driven in accordance with the levels of the outputs.

Similarly, the DC voltage generator detects both the output voltage and the output current. The voltage is detected and taken out by a DC voltage detector 912 connected in parallel with a rectification smoothing circuit provided to an output winding N2_DC 913 of the high voltage transformer. The current is detected and taken out by connecting a DC detector 914 between the output winding and the ground. Similar to the AC, each of the detection signals of the voltage and the current is compared with the reference signals of Vref_DC_V 909 and Vref_DC_I 910, thereby regulating the DC component of the high voltage output.

The foregoing descriptions pertain to application of the superimposed bias to transfer the toner image on the intermediate transfer belt to the recording medium. As described above, in order to produce the AC-DC superimposed bias in which the AC voltage component is superimposed on the DC voltage component, various components are required. For example, even when an image forming apparatus is equipped with devices for supplying the DC voltage as in known image forming apparatuses, devices for superimposing the AC voltage on the DC voltage are needed as illustrated in FIGS. 6 through 9. Such devices include the AC detector, the voltage control comparator, and the current control comparator, in addition to the AC driver 121, the AC high voltage transformer 122, the AC output detector 123, and the AC controller 124. Various signal lines connecting to the controller 300 are also required.

As is generally the case for the image forming apparatus, in order to produce the AC-DC superimposed bias, the number of parts are required, thereby complicating arrangement of the parts in the image forming apparatus and complicating efforts to make the image forming apparatus as a whole as compact as is usually desired. Furthermore, as the individual constituent parts for application of the AC-DC superimposed bias are mounted in the image forming apparatus one by one, assembly becomes complicated, increasing the risk of misassembly.

In a case in which a user wishes to add additional devices for application of the AC-DC superimposed bias to the image forming apparatus later as an option, the image forming apparatus needs an extra space for the additional devices.

As is generally the case for the image forming apparatus, devices that are not expected to be touched by a user are normally disposed at the back of the image forming apparatus. In such a case, upon installation of the devices for application of the AC-DC superimposed bias, technicians need to access the back of the image forming apparatus, which is generally facing a wall of the office. The image forming apparatus may need to be moved so that the technicians can work at the back of the image forming apparatus. Moreover, the devices for application of the AC-DC superimposed bias are comprised of a plurality of parts, complicating installation of these parts in the image forming apparatus and hence leading to prolonged downtime.

In view of the above, according to an illustrative embodiment of the present invention, the devices for application of the AC-DC superimposed bias are constituted as a single integrated unit, that is, constituted as a submodule (power supply module) 500, detachably attachable relative to the image forming apparatus. The submodule 500 includes one or more circuit boards on which the constituent components for application of the AC-DC superimposed bias are disposed. However, disposing the components on a single circuit board can reduce the size of the submodule 500 as a whole and also can reduce the amount of associated wiring, hence reducing overall cost.

Figure 10:
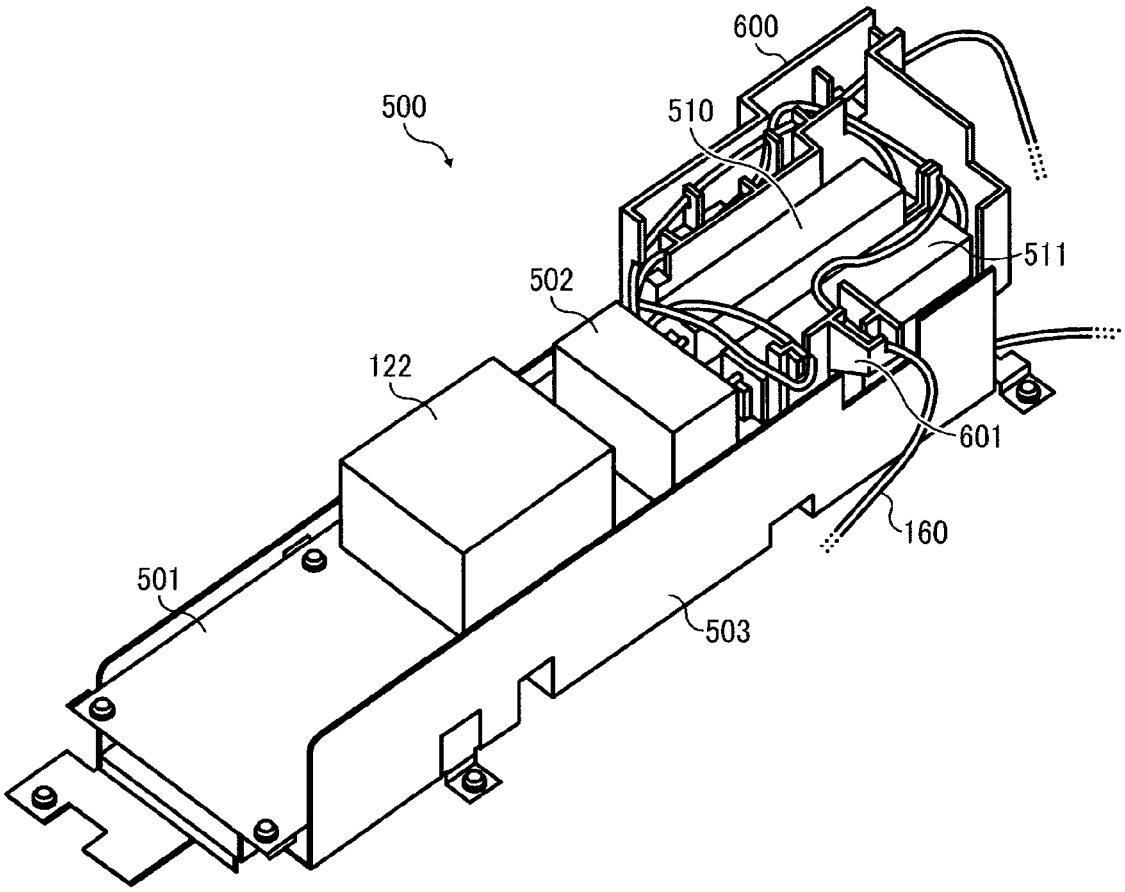
FIG. 10 is a perspective view schematically illustrating an example of a submodule for application of the AC-DC superimposed bias.

With reference to FIG. 10, a description is provided of the submodule 500.

FIG. 10 is a perspective view schematically illustrating an example configuration of the submodule 500. FIG. 10 illustrates the second power source unit 111 indicated by a broken line shown in FIG. 7 serving as the submodule 500. According to the present illustrative embodiment shown in FIG. 10, the submodule 500 includes the first relay 510 and the second relay 511. It is to be noted that FIG. 10 shows representative components of the submodule 500. However, the constituent components are not limited to the structure illustrated in FIG. 10.

As illustrated in FIG. 10, the submodule 500 includes a bias application circuit board 501 for application of the AC-DC superimposed bias, the AC high voltage transformer 122, the first relay 510, the second relay 511, and a terminal block 502. The first relay 510 and the second relay 511 switch between the first power source unit 110 for application of the DC voltage and the second power source unit 111 (that is, the submodule 500) for application of the AC-DC superimposed bias. The terminal block 502 connects the power source unit and the submodule 500 to the secondary transfer counter roller 73 via the first relay 510 and the second relay 511.

Alternatively, as compared with the exemplary configuration of the submodule 500 shown in FIG. 10, the second power source unit 111 for application of the AC voltage may constitute the submodule 500, or the second power source unit 111 including the first relay 510 without the second relay 511 as illustrated in FIG. 8 may constitute the submodule 500. Alternatively, the first power source unit 110 in which the power source unit for application of the AC voltage and the power source unit for application of the DC voltage are constituted as a single integrated unit as illustrated in FIG. 9 may constitute the submodule 500. In this case, a structure capable of application of the AC-DC superimposed bias is preinstalled in the image forming apparatus.

According to the present illustrative embodiment, in the submodule 500, the constituent components for application of the AC-DC superimposed bias such as the AC high voltage transformer 122 and the terminal block 502 are disposed on the bias application circuit board 501. Furthermore, as illustrated in FIG. 10, the submodule 500 includes the first relay 510 and the second relay 511 for switching between the DC bias and the AC-DC superimposed bias as a single integrated unit. It is to be noted that the first relay 510 and the second relay 511 may be disposed on the bias application circuit board 501 for application of the AC-DC superimposed bias. Alternatively, the first relay 510 and the second relay 511 may be disposed separately from the bias application circuit board 501, but within the submodule 500.

In a case in which the first relay 510 and the second relay 511 are disposed integrally in the submodule 500 as illustrated in FIG. 10, when the AC voltage is not needed only the bias with the DC voltage component need be applied as in the known transfer device, but with a simpler and more energy-efficient configuration than the known transfer device. That is, this configuration facilitates installation of the components for application of the AC-DC superimposed bias optionally in the image forming apparatus that transfers an image using only the DC voltage.

As described above, according to the illustrative embodiment of the present invention, the constituent components for application of the AC-DC superimposed bias are constituted as a single integrated unit as the submodule 500 which is detachably attachable relative to the image forming apparatus. With this configuration, upon installation of the submodule 500, the technicians can place the submodule 500 at a predetermined place in the image forming apparatus, and simply connect wiring and harnesses to the submodule 500, thereby enabling the image forming apparatus to apply superimposed bias with a simple configuration.

Furthermore, this configuration provides the greater compactness that is usually desired of an image forming apparatus. According to the illustrative embodiment, the submodule 500 may be attached optionally to the image forming apparatus using screws, for example. Upon request from the user, the technicians can bring and attach the submodule 500 for application of the AC-DC superimposed bias to the image forming apparatus optionally using the screws without disassembling the image forming apparatus. This arrangement reduces downtime significantly.

Although the submodule 500 may be disposed at any place in the image forming apparatus, preferably, the submodule 500 may be disposed inside the transfer unit 200 for greater compactness. More specifically, the submodule 500 may be disposed inside the loop formed by the intermediate transfer belt 50 so that the size of the existing image forming apparatus does not need to be changed. This configuration is advantageous when the submodule 500 including the first relay 510 and the second relay 511 for switching between the DC bias and the AC-DC superimposed bias is provided optionally to the image forming apparatus to enable the image forming apparatus to apply the AC-DC superimposed bias.

With reference to FIGS. 11 through 14, a description is provided of installation of the submodule 500 in the transfer unit 200 of the image forming apparatus according to an illustrative embodiment of the present invention. FIG. 11A is a schematic diagram illustrating the transfer unit 200 in the image forming apparatus. FIG. 11B is a schematic diagram illustrating the transfer unit 200 moved towards the proximal end of the image forming apparatus in the direction indicated by an arrow in FIG. 11A.

Generally, the transfer unit 200 disposed in the image forming apparatus can be taken out to the proximal end of the image forming apparatus along a rail or the like (not illustrated). If the submodule 500 is detachably attachable relative to the transfer unit 200, when installing the submodule 500 in the image forming apparatus, only the proximal side (front side) of the image forming apparatus is accessed and the submodule 500 can be installed with ease without accessing the back of the image forming apparatus.

Figure 12:
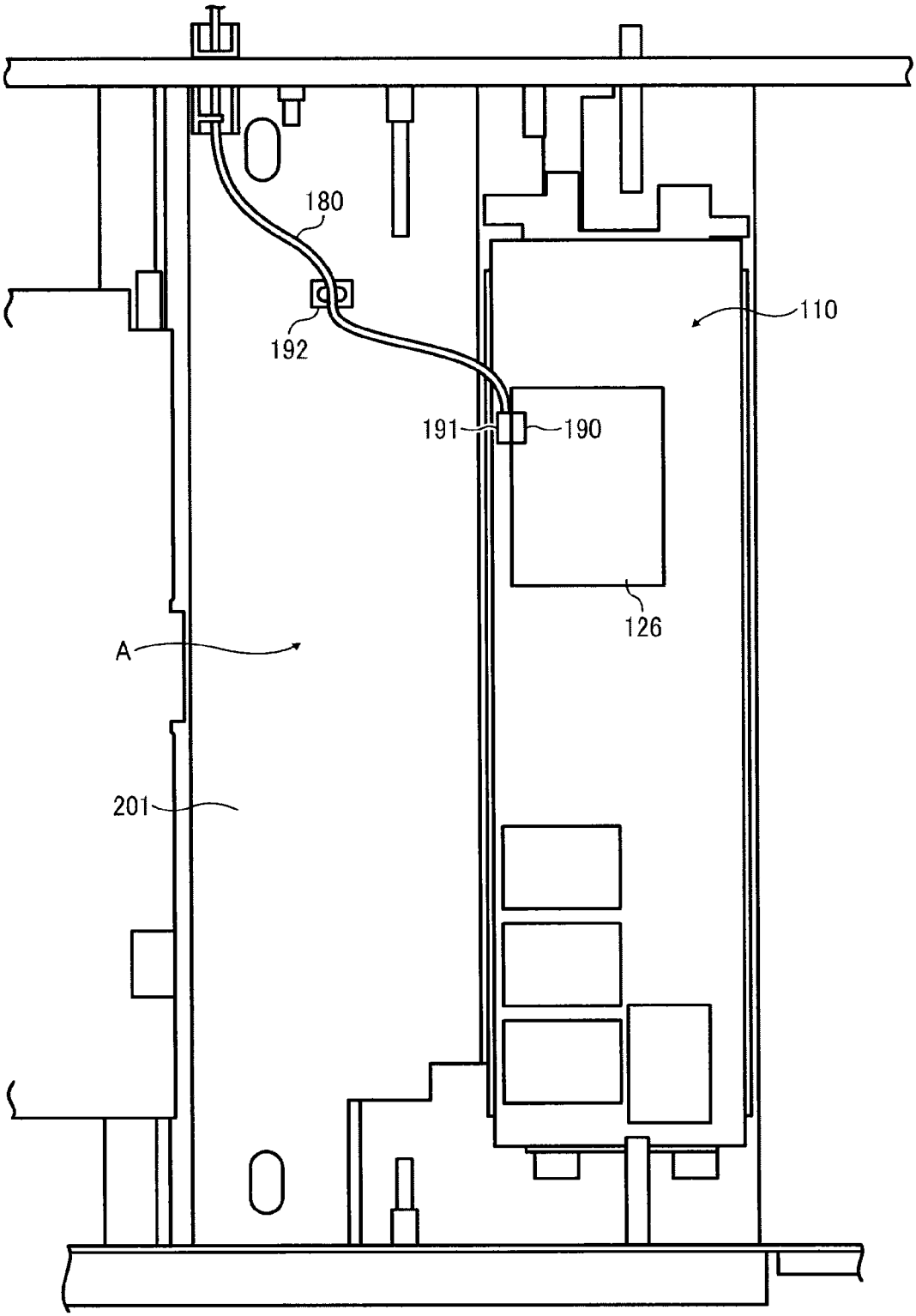
FIG. 12 is a top view schematically illustrating a portion of the transfer unit including a mounting space for the submodule, as viewed from the top of the image forming apparatus.

As illustrated in FIG. 12, the first power source unit 110 for application of the DC voltage (the power source unit 110 of FIG. 7) is disposed in the transfer unit 200 above a control circuit board for the transfer unit 200. FIG. 12 is a top view schematically illustrating a portion of the transfer unit 200 as viewed from the top of the image forming apparatus.

In known image forming apparatuses, the power source unit (equivalent to the power source unit 110) for the DC voltage and the control board for the transfer unit (equivalent to the transfer unit 200) that also controls the power source unit for the DC voltage are disposed in parallel in the horizontal direction (corresponding to a left-right direction in FIG. 12). By contrast, according to the illustrative embodiment, the power source unit 110 is disposed above the control board for the transfer unit 200 in the vertical direction so that a mounting space A is formed. With this configuration, the submodule 500 can be disposed at the mounting space A.

Alternatively, the power source unit 110 for application of the DC voltage may be disposed below the control board of the transfer unit 200. In other words, the power source unit 110 and the control board are stacked vertically in a recessed portion of the transfer unit 200.

FIG. 12 illustrates a portion of the transfer unit 200 as viewed from the top thereof after the transfer unit 200 is taken out from the image forming apparatus and the intermediate transfer belt 50 is removed from the transfer unit 200. Further, a top cover covering the power source unit 110 is also removed in FIG. 12.

In FIG. 12, the power source unit 110 includes the DC high voltage transformer 126, a connector terminal 190 provided to the DC high voltage transformer 126, a first harness 180 for the transfer electric field connected to the secondary transfer counter roller 73 or the secondary transfer roller 80, a connector terminal 191 connected to the connector terminal 190 of the DC high voltage transformer 126, and so forth. In a state in which the submodule 500 is not installed in the transfer unit 200, the DC output from the DC high voltage transformer 126 is provided to the secondary transfer counter roller 73 or to the secondary transfer roller 80 via the first harness 180 by connecting the connector terminal 191 to the connector terminal 190.

It is to be noted that an upper surface of a unit frame 201 of the transfer unit 200 is provided with a clamp 192 to clamp the first harness 180. Accordingly, the first harness 180 can be fixed reliably to the unit frame 201 when the submodule 500 is not installed.

Figure 13:
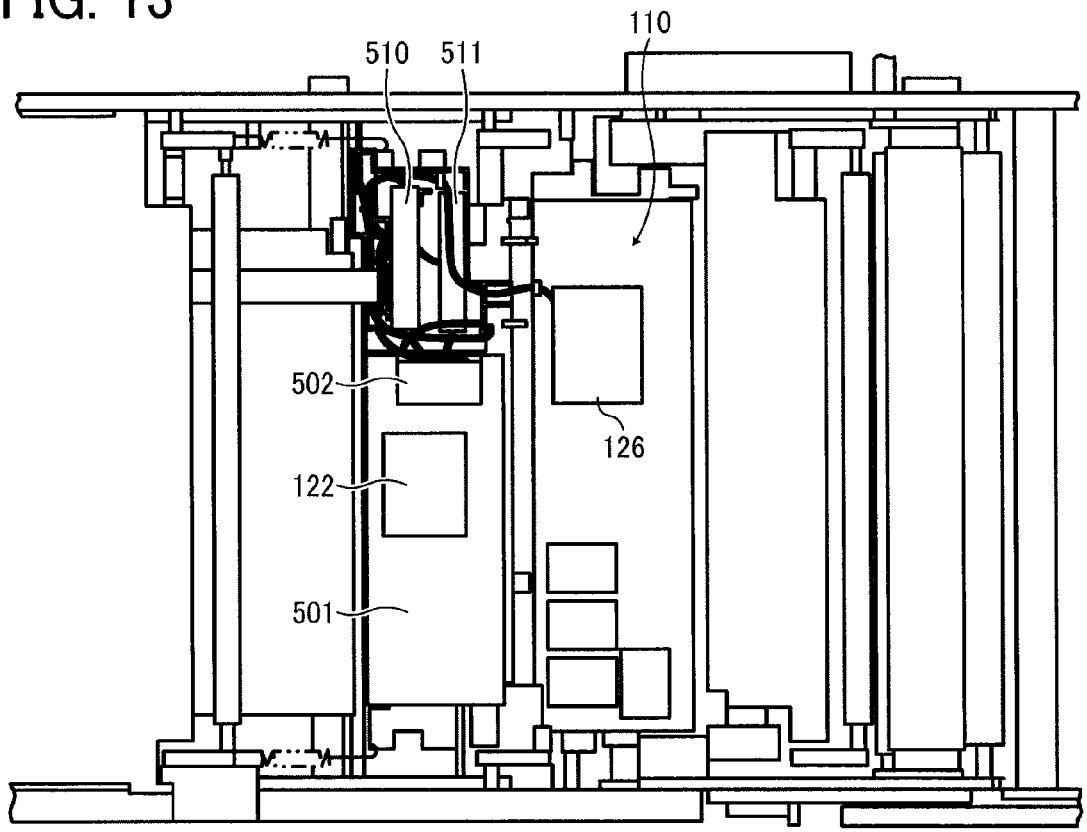
FIG. 13 is a top view schematically illustrating the transfer unit when the submodule is disposed in the mounting space of FIG. 12.

Referring now to FIG. 13, a description is provided of installation of the submodule 500 in the mounting space A. FIG. 13 is a top view schematically illustrating a portion of the intermediate transfer unit 200 as viewed from the top thereof. Similar to FIG. 12, FIG. 13 illustrates a portion of the transfer unit 200 as viewed from the top thereof after the transfer unit 200 is taken out from the image forming apparatus and the intermediate transfer belt 50 is removed from the transfer unit 200. Furthermore, the top cover covering the power source unit 110 is also removed. As illustrated in FIG. 13, the submodule 500 is disposed at the side of the power source unit 110 and the control board vertically stacked (at the left side in FIG. 13). With this configuration, the submodule 500 can be added to the image forming apparatus without changing the original size of the image forming apparatus.

Figure 14:
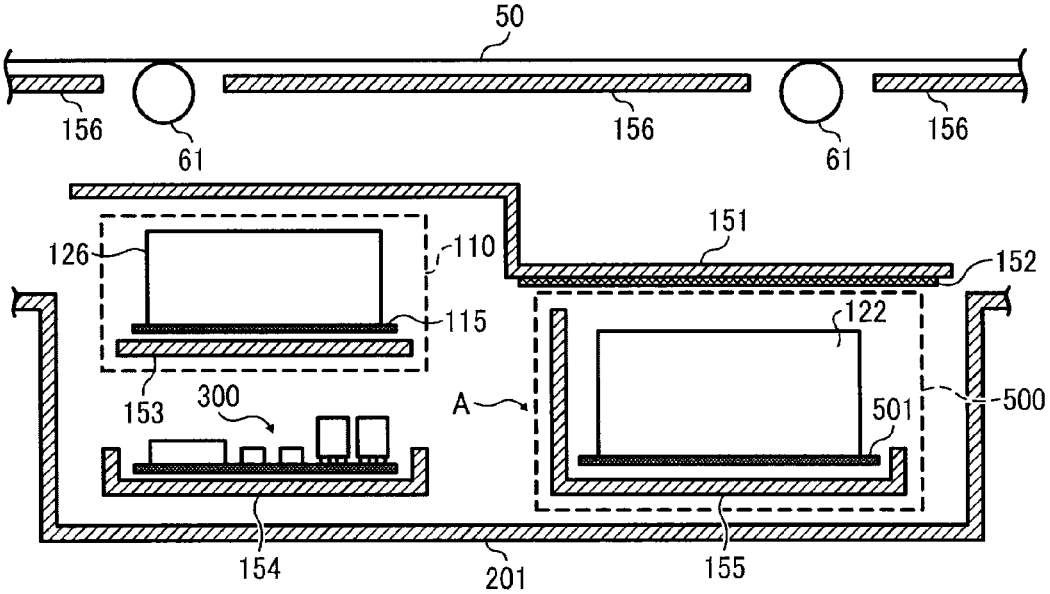
FIG. 14 is a cross-sectional view schematically illustrating the submodule disposed in the transfer unit as viewed from the front of the transfer unit.

FIG. 14 is a cross-sectional view schematically illustrating the submodule 500 disposed in the transfer unit 200 as viewed from the front of the image forming apparatus. It is to be noted that because FIG. 14 is a schematic diagram as viewed from the front side of the intermediate transfer unit 200, the positional relations of the transfer unit 200 in the horizontal direction are reverse as compared with the positional relations shown in FIG. 13. The upper side of FIG. 13 corresponds to the front side of the intermediate transfer unit 200, and the lower side corresponds to the back of the intermediate transfer unit 200.

In FIG. 14, the unit frame 201 of the transfer unit 200 is disposed inside the loop formed by the intermediate transfer belt 50, and supports the DC power source unit 110, the control board 300, and the submodule 500. FIG. 14 illustrates the submodule 500 disposed in the transfer unit 200, and the DC power source unit 110 disposed above the control board 300.

As illustrated in FIG. 14, a portion of the frame 201 is recessed downward. The DC power source unit 110, the control board 300, and the submodule 500 are disposed in the recessed portion of the frame 201 of the transfer unit 200. A metal shield 151 covers the top of the recessed portion of the frame 201 to cover the DC power source unit 110, the control board 300, and the submodule 500 disposed in the recessed portion of the unit frame 201. An insulating sheet 152 is attached to the lower surface of the metal shield 151 facing the submodule 500. The metal shield 151 is detachably attachable relative to the transfer unit 200, thereby facilitating installation of the submodule 500 and maintenance of components with ease.

The DC power source unit 110 includes a circuit board 115 for application of the DC. The circuit board 115 includes the high voltage transformer 126. The circuit board 115 is supported by a metal planar member 153. The control board 300 for controlling the transfer unit 200 is supported by a metal planar member 154. The bias application circuit board 501 of the submodule 500 includes the AC high voltage transformer 122. The circuit board 501 is supported by a metal planar member 155.

An upper metal planar member 156 is disposed between the primary transfer rollers 61 such that the upper metal planar member 156 covers the DC power source unit 110, the control board 300, the submodule, and so forth disposed beneath the metal planar member 151. The metal planar member 156 is also detachably attachable relative to the transfer unit 200.

Figure 11A:
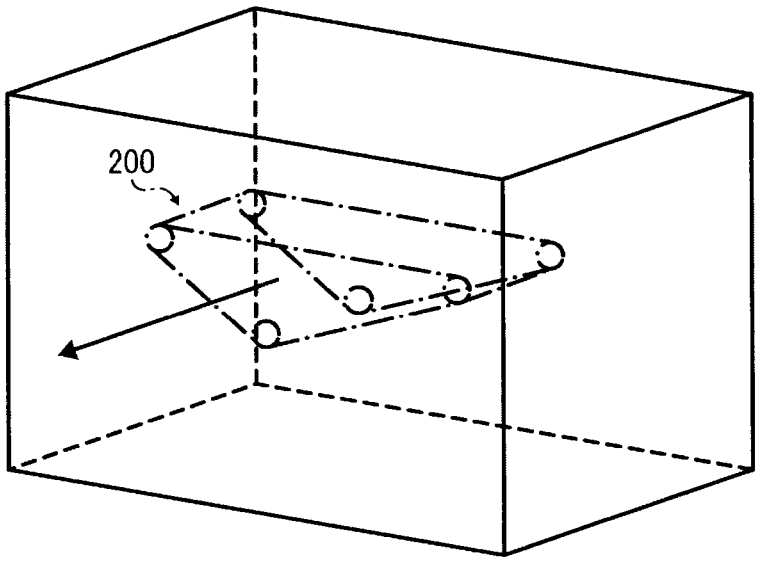
FIG. 11A is a schematic diagram illustrating the transfer unit being taken out from the image forming apparatus main body.
Figure 11B:
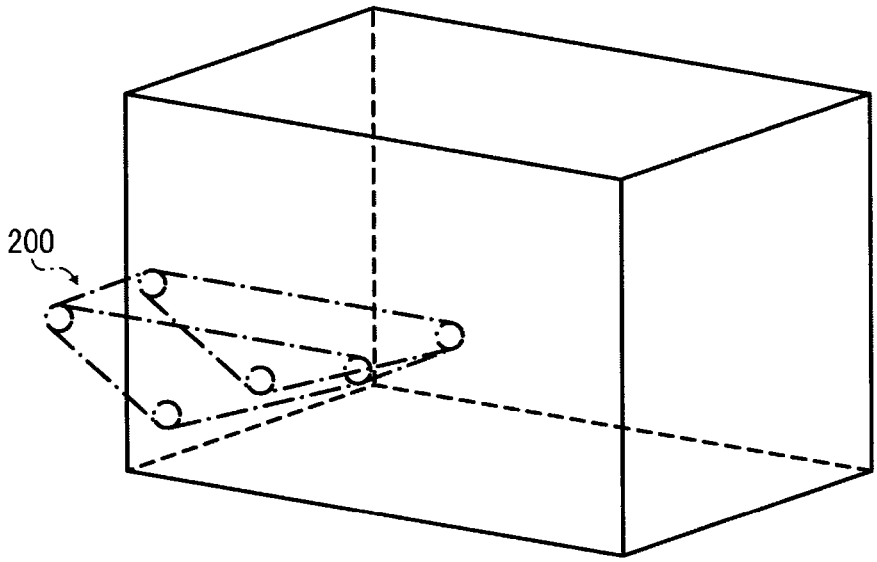
FIG. 11B is a schematic diagram illustrating the transfer unit taken out from the image forming apparatus main body.

With reference to FIGS. 10 through 12, a description is provided of installation of the submodule 500 in the image forming apparatus. First, as illustrated in FIG. 11B, the transfer unit 200 is pulled out to the front of the image forming apparatus. Subsequently, the intermediate transfer belt 50 is removed from the transfer unit 200, and the cover is removed to install the submodule 500. This state is shown in FIG. 12. Subsequently, the connector terminal 191 shown in FIG. 12 is disconnected from the connector terminal 190. The first harness 180 is removed from the clamp 192. In this state, the submodule 500 is installed in the mounting space A. The submodule 500 is fixed to the mounting space A using a screw or any other suitable fixing member.

Subsequently, the harnesses are connected such that the submodule 500 and the power source unit 110 are connected as illustrated in FIG. 7.

Figure 15:
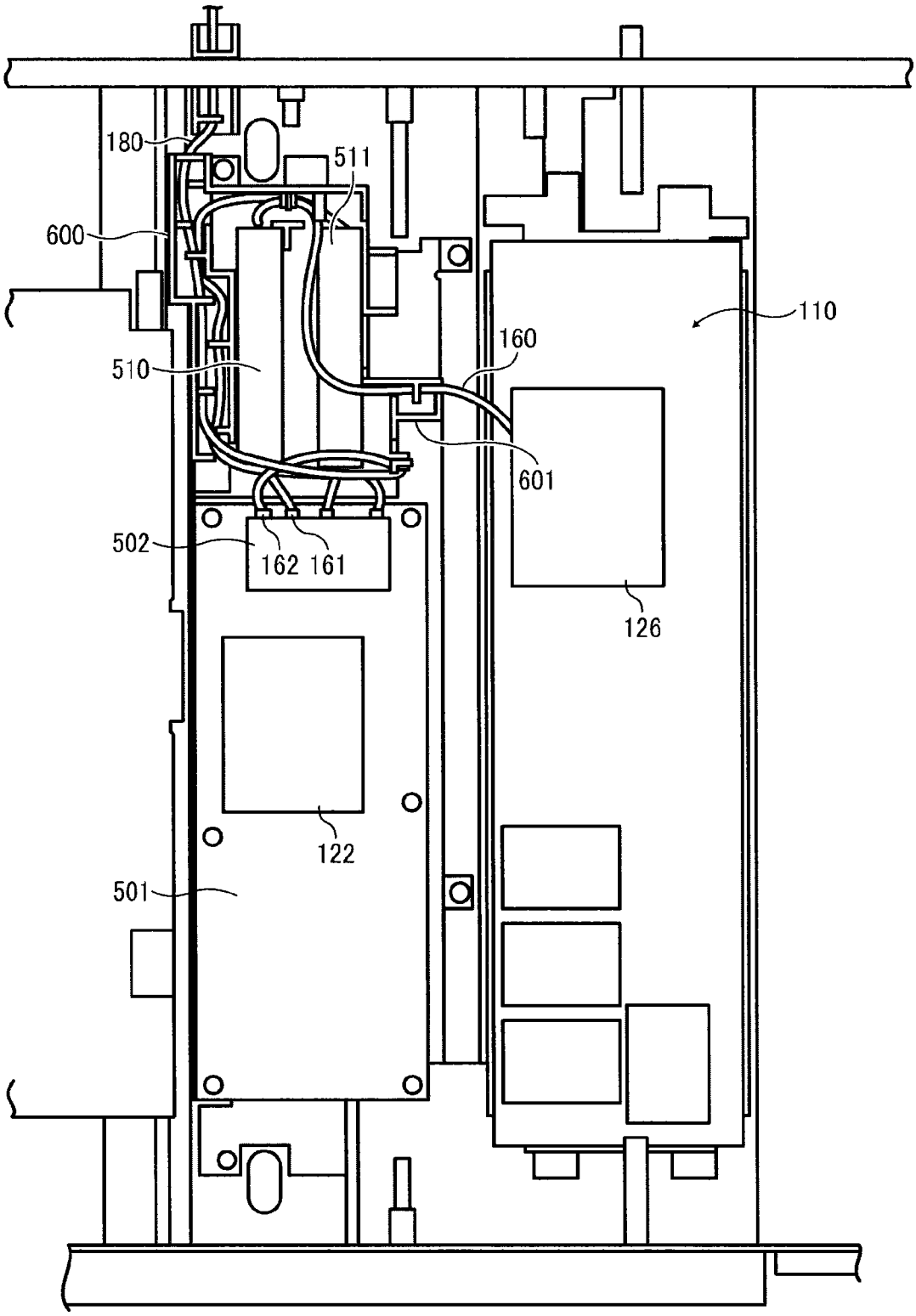
FIG. 15 is a top view schematically illustrating the submodule disposed in the transfer unit.
Figure 16:
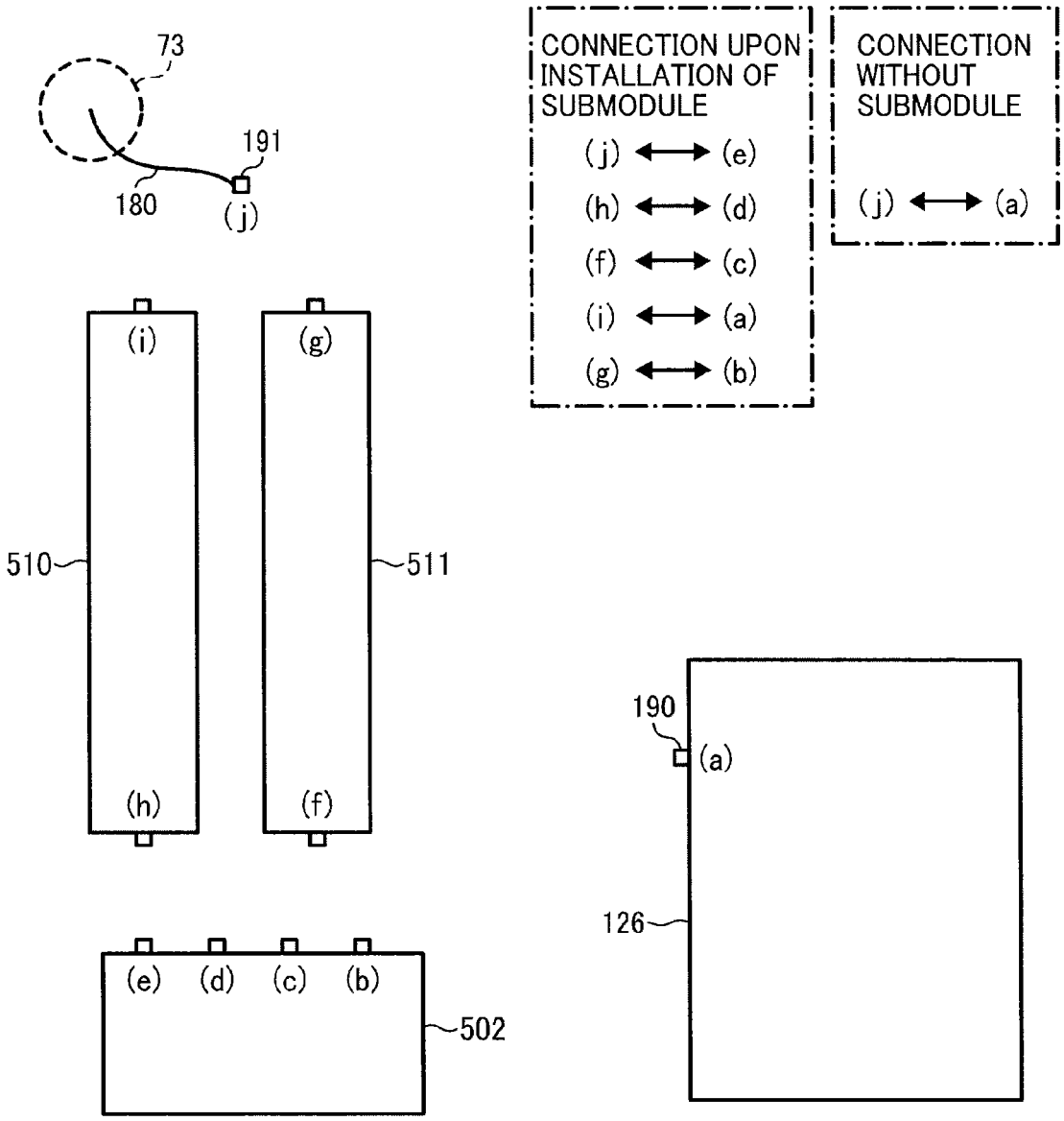
FIG. 16 is a partially exploded schematic diagram of FIG. 15 illustrating connection of the connectors.

With reference to FIGS. 15 and 16, a description is now provided of connecting the submodule 500 and the DC power source unit 110. FIG. 15 is a top view schematically and partially illustrating the submodule 500 disposed in the transfer unit 200. FIG. 16 is a partially exploded diagram of FIG. 15 illustrating connection of the connecting portions of the submodule 500 and the DC power source unit 110.

As illustrated in FIG. 16, the high voltage transformer 126 of the DC power source unit 110 includes a connecting portion (a) corresponding to the connector terminal 190. The terminal block 502 of the submodule 500 includes connecting portions (b) through (e). The connecting portions (c) and (e), and the connecting portions (d) and (e) are connected electrically on the terminal block 502. Similarly, the first relay 510 of the submodule 500 includes connecting portions (h) and (i). The second relay 511 includes connecting portions (f) and (g). The first harness 180 from the secondary transfer counter roller 73 includes a connecting portion (j) which corresponds to the connector terminal 191.

When the submodule 500 is not mounted, there is only one path, that is, the connecting portions (a) and (j) are connected. When the submodule 500 is mounted, 5 paths are formed, that is, between the connecting portions (j) and (e), between the connecting portions (h) and (d), between the connecting portions (f) and (c), between the connecting portions (i) and (a), and between the connecting portions (g) and (d). It is to be noted that the connecting portion (b) of the terminal block 502 is a connecting portion that leads to the AC high voltage transformer 122 of the submodule 500.

Upon installation of the submodule 500, connection of the first harness 180 can be changed such that the first harness 180 is detached from the clamp 192 illustrated in FIG. 12, and the connector terminal 191 (connecting portion (j)) at the end of the first harness 180 is detached from the connector terminal 190 (connecting portion (a)) of the high voltage transformer 126 of the DC power source. Subsequently, the connecting portion (j) at the end of the first harness 180 is connected to the connecting portion (e) of the terminal block 502. The connecting portion (i) of the first relay 510 is connected to the connector terminal 190 (the connecting portion (a)) of the high voltage transformer 126 by using a second harness 160 as illustrated in FIG. 15. Other paths are connected in the submodule 500 in advance. One end of the second harness 160 may be connected to the connecting portion (i) of the first relay 510 in advance in the submodule 500.

As described above, the configuration capable of applying the superimposed bias as illustrated in FIG. 7 can be formed with two simple connecting operations. That is, the connector terminal 191 (the connecting portion (j)) at the end of the harness 180 is detached from the connector terminal 190 (connecting portion (a)) and then connected to the connecting portion (e) of the terminal block 502, while the connecting portion (i) and the connecting portion (a) are connected by the second harness 160. With this configuration, the configuration capable of applying the AC-DC superimposed bias as illustrated in FIG. 7 is accomplished with two simple steps.

The signal lines connecting the submodule 500 and the control circuit 300 may be grouped together as a signal-line group connector when the submodule 500 is assembled. The submodule 500 and the control circuit 300 are connected by simply connecting the signal-line group connector with the connectors of the control circuit 300 detachably attachable relative to the signal-line group connector.

As described above, with the configuration as illustrated in FIG. 7, when the AC voltage is not necessary, only the DC voltage component can be supplied easily in an energy-efficient way as in known image forming apparatuses. Providing the submodule 500 in the transfer unit 200 as illustrated in FIGS. 11 through 15 enables the transfer unit 200 to apply the AC-DC superimposed bias easily and quickly without occupying a lot of space in the office.

It is to be noted that the terminal block 502 may be eliminated, and the connector terminal 190 (connecting portion (a)) and the connecting portion (e) may be connected while connecting the connector terminal 191 (connecting portion (j)) and the connecting portion (d). In this case, however, the connected connectors are arranged flexibly in the submodule 500, and hence may touch other components, which may result in a failure of the device.

More specifically, because the first harness 180 for the transfer electric field is provided with the connector terminal 191 and supplied with the AC current of the high voltage, undesirable noise may be generated if the first harness 180 contacts other components and the transfer unit 200. When this occurs, such noise may be transmitted to the photoconductive drum 11 and other components via the transfer unit 200, thereby adversely affecting the latent image formed on the photoconductive drum 11 and hence hindering imaging quality. In view of the above, it is preferable that the terminal block 502 be provided.

In order to prevent the second harness 160 supplied with the high voltage DC voltage from contacting the transfer unit 200 when the second harness 160 is guided to the first relay 510, a first insulating guide 601 is provided to hold the second harness 160. The first insulating guide 601 guides the second harness 160 to the first relay 510 without directly contacting the transfer unit 200, thereby preventing the above-described noise. The first insulating guide 601 is made of material having high insulating properties, such as resin.

Similarly, in order to prevent the first harness 180 from contacting the transfer unit 200 when the first harness 180 is guided to the terminal block 502, a second insulating guide 600 is provided to hold the first harness 180. The second insulating guide 600 guides the first harness 180 supplied with the high voltage AC voltage to the terminal block 502 without directly contacting the transfer unit 200, thereby preventing the above-described noise. The second insulating guide 600 is also made of material having high insulating properties, such as resin.

The number of constituent elements, locations, shapes and so forth of the constituent elements are not limited to any of the structure for performing the methodology illustrated in the drawings. For example, according to the illustrative embodiments shown in FIGS. 10 and 15, the first relay 510 and the second relay 511 are integrally disposed in the submodule 500. Alternatively, the submodule 500 without the first relay 510 and the second relay 511 may be mounted in the transfer unit 200.

The foregoing embodiments relate to the intermediate transfer method in which the intermediate transfer belt 50 serves as an image bearing member onto which a toner image is transferred. The present invention is not limited to the intermediate transfer method. For example, the present invention can be applied to a direct transfer method in which a toner image formed on the photoconductive drum is transferred directly onto a recording medium by the transfer electric field acting between the photoconductive drum and a transfer device (i.e. a transfer roller and a transfer charger) facing or contacting the photoconductive drum. In this case, the photoconductive drum serves as an image bearing member, and the AC-DC superimposed bias is applied to the transfer charger or the transfer roller facing or contacting the photoconductive drum.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearing member to bear a toner image on a surface thereof;

a transfer unit including a transfer device to transfer the toner image onto a recording medium, disposed opposite the image bearing member;

a direct current (DC) power source to apply, between the image bearing member and the transfer device, a DC bias to form a first transfer electric field to transfer the toner image onto the recording medium; and a power supply module detachably attachable relative to the image forming apparatus, the power supply module including an AC-DC superimposed bias power source to apply, between the image bearing member and the transfer device, a superimposed bias in which an alternating voltage is superimposed on a DC voltage to form a second transfer electric field to transfer the toner image onto the recording medium.

2. The image forming apparatus according to claim 1, wherein the power supply module comprises:

a first relay disposed on a superimposed bias application path to the transfer device; and a second relay disposed on a DC transfer bias application path to the transfer device.

3. The image forming apparatus according to claim 2, wherein, in an installed state in which the power supply module is mounted in the image forming apparatus, the first transfer electric field and the second transfer electric field are switched by switching contacts of the first relay and the second relay.

4. The image forming apparatus according to claim 3, wherein the transfer unit includes a first harness dedicated for the transfer electric field including a connector terminal at one end thereof that is detachably attachable relative to the DC power source and the power supply module, the other end of the harness connected to the transfer device.

5. The image forming apparatus according to claim 4, wherein the power supply module comprises a terminal block including:

a first terminal to connect an AC output portion of the power supply module and one end of the second relay;

a second terminal to connect to the other end of the second relay;

a third terminal connected to a first end of the first relay; and a fourth terminal connectable to the connector terminal of the harness and connected electrically to the second and the third terminals, wherein, in the installed state in which the power supply module is mounted in the image forming apparatus, the connector terminal is connected to the fourth terminal while connecting the DC power source to a second end of the first relay, the second end opposite the first end connected to the third terminal.

6. The image forming apparatus according to claim 5, wherein the transfer unit further comprises:

a power supply module mount on which the power supply module is mounted;

the power supply module mounted on the power supply module mount;

a second harness to connect the DC power source and the second end of the first relay; and a first insulating guide to hold the second harness such that the second harness does not contact the transfer unit when the second harness connects the DC power source and the second end of the first relay.

7. The image forming apparatus according to claim 5, wherein the transfer unit further comprise:

a power supply module mount on which the power supply module is mounted;

the power supply module mounted on the power supply module mount; and a second insulating guide to hold the first harness such that the first harness does not contact the transfer unit when the first harness is connected to the terminal block.

8. The image forming apparatus according to claim 1, wherein the power supply module comprises a bias application circuit board on which components to superimpose the AC voltage on the DC voltage are mounted.

9. The image forming apparatus according to claim 8, wherein the components disposed on the bias application circuit board include the AC-DC superimposed bias power source and a high-voltage AC transformer.

10. The image forming apparatus according to claim 9, wherein the components further include a first relay disposed on a superimposed bias application path to the transfer device; and a second relay disposed on a DC transfer bias application path to the transfer device.

11. A power supply module detachably attachable relative to an image forming apparatus, comprising:

a power source to output a superimposed bias in which an AC voltage is superimposed on a DC voltage, wherein the superimposed bias is applied to a transfer device of the image forming apparatus.

12. An image forming apparatus, comprising:

an image bearing member to bear a toner image;

a transfer device that transfers the toner image from the image bearing member to a sheet;

a direct current bias power source that applies a direct current bias to the transfer device; and a power supply module detachably attachable to the image forming apparatus, the power supply module including a superimposed bias power source that applies a superimposed bias in which an alternating current component is superimposed on a direct current component to the transfer device.

13. The image forming apparatus according to claim 12, wherein the power supply module includes a switching mechanism that switches an electrical connection to the transfer device such that a bias applied to the transfer device is switched between the direct current bias and the superimposed bias.

14. The image forming apparatus according to claim 13, wherein the switching mechanism includes a relay.

15. The image forming apparatus according to claim 13, further comprising:

a controller that controls the switching mechanism, the direct current bias power source and the superimposed bias power source.

16. The image forming apparatus according to claim 12, wherein the transfer device includes a transfer roller that forms a transfer nip between the transfer roller and the image bearing member.

17. The image forming apparatus according to claim 16, wherein the transfer device includes a counter roller opposed to the transfer roller.

18. The image forming apparatus according to claim 12, wherein the image bearing member is an intermediate transfer belt on which the toner image is transferred from a photoconductive drum.

* * * * *